US006808005B2

(12) United States Patent
Bloch et al.

(10) Patent No.: US 6,808,005 B2
(45) Date of Patent: Oct. 26, 2004

(54) METHOD AND APPARATUS FOR EXTRACTING CASTINGS PRODUCED IN A MOULD FOUNDRY PLANT

(75) Inventors: Anders Clemens Bloch, Helsinge (DK); Michael Sander Jensen, Frederikssund (DK)

(73) Assignee: Disa Industries A/S, Herlev (DK)

( * ) Notice: Subject to any disclaimer, the term of this patent is extended or adjusted under 35 U.S.C. 154(b) by 0 days.

(21) Appl. No.: 10/450,044

(22) PCT Filed: Dec. 15, 2000

(86) PCT No.: PCT/DK00/00701

§ 371 (c)(1),
(2), (4) Date: Jun. 10, 2003

(87) PCT Pub. No.: WO02/47851

PCT Pub. Date: Jun. 20, 2002

(65) Prior Publication Data

US 2004/0011497 A1 Jan. 22, 2004

(51) Int. Cl.[7] ..... B22D 29/00
(52) U.S. Cl. ..... 164/131; 164/344; 164/404
(58) Field of Search ..... 164/131, 344, 164/404

(56) References Cited

U.S. PATENT DOCUMENTS 4,359,083 A * 11/1982 Jacobsen ..... 164/404
6,092,585 A * 7/2000 Larsen et al. ..... 164/130
6,390,174 B1 * 5/2002 Bloch et al. ..... 164/131
6,622,775 B2 * 9/2003 Crafton et al. ..... 164/131

FOREIGN PATENT DOCUMENTS

JP 64-83370 * 3/1989

* cited by examiner

*Primary Examiner*—Kilay Stoner
*Assistant Examiner*—I. H. Lin
(74) *Attorney, Agent, or Firm*—Stites & Harbison PLLC; Douglas E. Jackson

(57) ABSTRACT

When extracting the castings (5, 6) produced in a mould foundry plant, comprising an extraction station receiving the moulds (1, 2, 3) with solidified castings (5, 6) positioned in the mould cavities at the mould-parting surface between mould parts a part of the casting (5) to be extracted is gripped in a fixed position and orientation before opening the mould cavity containing said casting, said gripping providing a positive, fixed engagement between the gripping tool (8) and the casting (5), the mould cavity containing the gripped casting (5) is opened by removing a first mould part (1), the gripped casting (5) is extracted from the mould cavity, and the casting (5) is moved to a delivery position for further processing thereof. This provides a possibility of delivery of the extracted casting (5) in a well-defined position and orientation for the further processing thereof.

10 Claims, 2 Drawing Sheets

METHOD AND APPARATUS FOR EXTRACTING CASTINGS PRODUCED IN A MOULD FOUNDRY PLANT

CROSS REFERENCE TO RELATED APPLICATION

This application is a 371 of PCT/DK00/00701 filed on Dec. 15, 2000.

TECHNICAL FIELD

The present invention relates to a method and apparatus for extracting the castings produced in an automatic mould foundry plant, wherein the plant includes an extraction station receiving modules with solidified castings positioned in mould cavities at the mould-parting surface between mould parts.

BACKGROUND ART

In foundry plants of the mould-string type, it is known to perform the extraction using a robot for gripping the downstream mould part containing a casting at the downstream end thereof and move this mould part and casting to co-operate with an engagement member penetrating into the mould adjacent the casting and pulling the casting away from the mould part. A method and apparatus of this kind is known from WO 98/51433.

DISCLOSURE OF THE INVENTION

Based on this prior art it is the object of the present invention to provide a method and apparatus for extracting the castings produced in a mould foundry plant of the kind referred to above, with which it is possible to provide a well-defined and positive engagement with the casting in a fixed position and orientation, in order to be able to deliver the extracted casting in a well-defined position and orientation for further processing thereof, whereby the subsequent handling can be performed automatically with high precision, without further positioning adjustments and/or detection of position of the extracted casting, and this is achieved by a method and an apparatus as described below in the following detailed part. With this method and apparatus, it is achieved that the casting is gripped in a well-defined position and orientation, said position and orientation being secured by the closely juxtaposed mould parts, which are not moved relative to one another until after a secure gripping of the casting has been obtained.

Preferred embodiments of the method and apparatus, and the effects thereof (beyond what will be obvious to a skilled person) are explained in the following detailed part of the present description.

BRIEF DESCRIPTION OF THE DRAWINGS

In the following detailed part of the present description, the invention will be explained in more detail with reference to the exemplary embodiment of an automatic mould-string foundry plant according to the invention, shown in a highly simplified diagrammatic manner in the drawings, of which

DESCRIPTION OF THE PREFERRED EMBODIMENT

Figure 1:
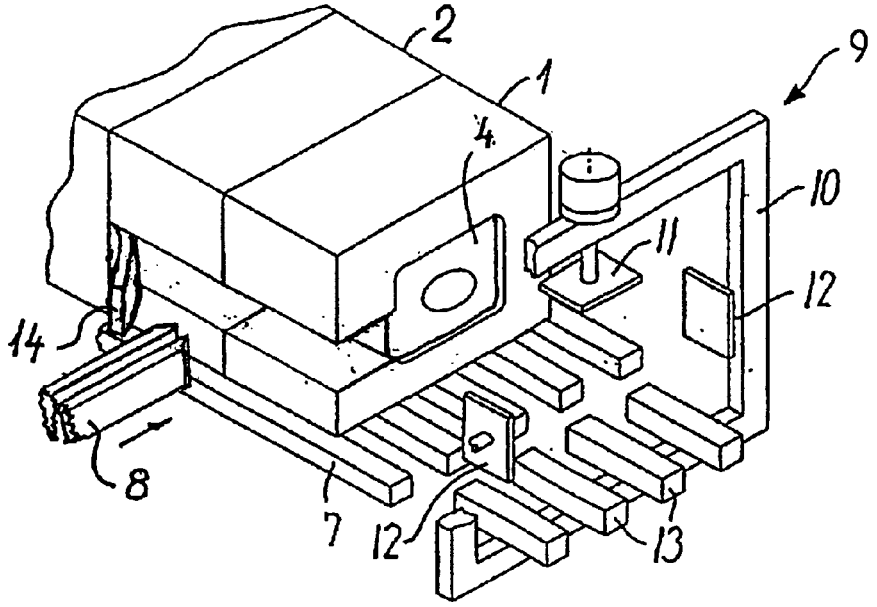
FIG. 1 is a perspective view showing the downstream end of a string of moulds carried and advanced on bars extending in the direction of movement, as well as a robot-gripping tool for gripping the castings and a removing means for removing the downstream mould part in order to open the mould cavity containing the casting.

The FIGS. 1–5 show a string of moulds, of which only the "oldest" or downstream mould 1 and the next following moulds 2 and 3 are shown, carrying in their casting cavities 4, castings 5 and 6, respectively. The downstream mould cavity 4 in the mould part 1 is empty, as the casting previously occupying said mould cavity 4 has been removed in a previous step.

The string of moulds 1, 2, 3, etc. rests on a supporting arrangement consisting of a number of parallel bars 7. The bars 7 may be part of a "walking conveyor" comprising at least two sets of bars alternatively lifting and advancing the string of moulds from a pouring station (not shown), but they may also be a simple "table top", on which the string of moulds slides being pushed by suitable means (not shown).

The extraction station, here simply the region immediately adjacent the downstream mould 1, comprises a gripping tool 8 mounted on a robotic arm (not shown) for gripping the casting 5 positioned in the mould cavity between the two downstream mould parts 1 and 2. The gripping tool comprises, in the exemplary embodiment shown, a pair of tongs 8 adapted to be carried and manipulated by a distal arm (not shown) on a robot (likewise not shown) being connected to the latter through a coupling part (also not shown) comprising the requisite mechanical, fluidic and/or electrical connections. The removing means 9 for removing the mould part 1 in order to open the mould comprises, in the exemplary embodiment shown, a rectangular frame 10 adapted to be carried and manipulated by a distal arm (not shown) on a robot (likewise not shown), being connected to the latter through a coupling part (also not shown) comprising the requisite mechanical, fluidic and/or electrical connections.

Figure 2:
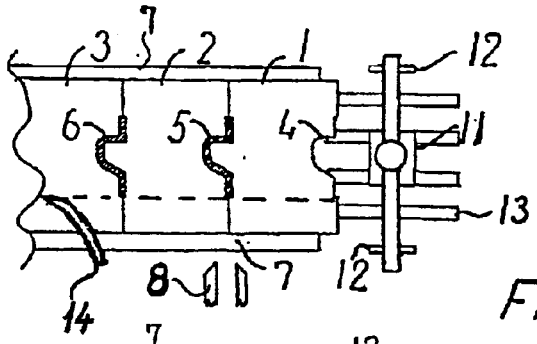
FIGS. 2–5 show the downstream end of a string of moulds, in which molten metal has previously been poured and then solidified prior to their arrival at said downstream end, showing successive steps during the gripping and extraction, using a robot gripper, of a casting from the downstream mould, as well as the removal of the downstream mould by means of the mould-removing means.
Figure 3:
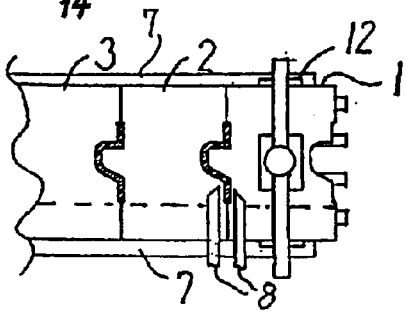
Figure 4:
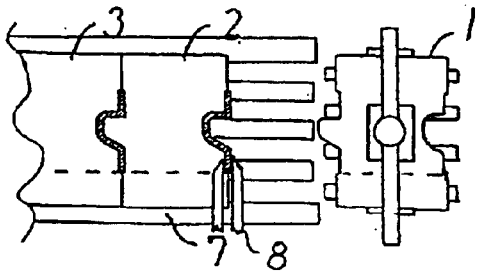

The removing means 9 comprises pressure pads 12 adapted to grip a mould between them by pressing against the lateral faces of the mould and further, a number of lifting bars 13 placed and spaced in such a manner that they can be inserted longitudinally into the spaces between the bars 7 and then raised so as to lift a mould free of the bars 7, after which the mould is moved away from the string of moulds in order to open the mould, as shown in the FIGS. 2–4. An upper pressure pad 11 may be provided to press the mould against the lifting bars 13, so as to increase the force to be used to pull the downstream mould 1 free from the casting 5 in the casting cavity between the two mould parts 1 and 2.

In the embodiment shown in FIG. 1, a tool 14 is used for removing parts of the moulds, in order to reduce the amount of mould material between the gripping tool 8 and the casting 5 before inserting the gripping tool 8 for gripping the casting 5. The mould-material-removing tool 14 shown in FIG. 1 consists of a simple scraper positioned to the side of the mould string and removes parts of the moulds by the movement of the mould string relative to said tool 14.

Figure 5:
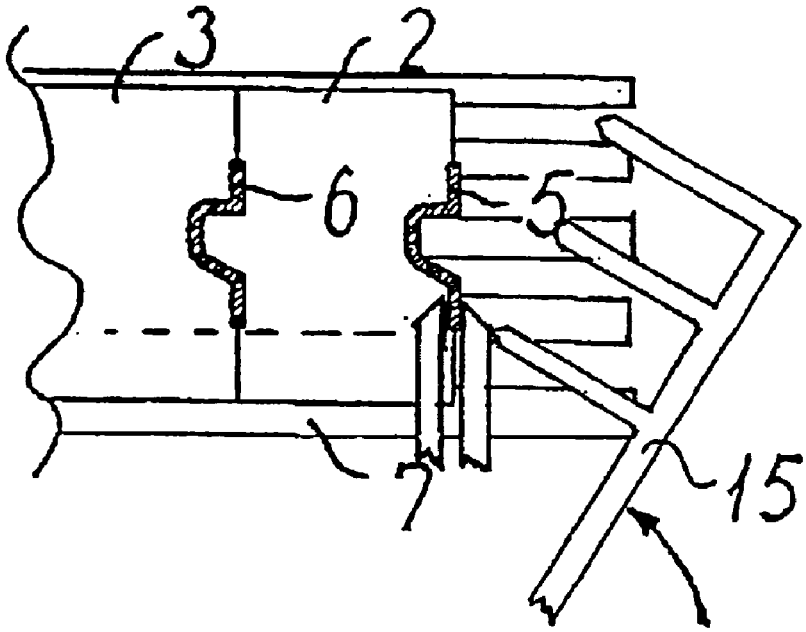

In the exemplary embodiment shown in FIG. 5, the gripping tool 8 is supplemented by a supporting structure 15, which is swingably connected to the same robotic arm as the gripping tool 8 and swings in underneath the casting 5 to be extracted before the casting is extracted. This supporting structure 15 is especially advantageous in connection with relatively heavy castings 5.

Referring to FIG. 2, the mould string 1, 2, 3, etc. has been moved downstream to position the downstream mould part 1 at the end of the supporting bars 7. The removing means 9 is brought to a position for engaging the downstream mould part 1 and the gripping tool 8 is brought to a position ready for penetrating the mould material.

In FIG. 3, the removing means 9 is brought into engagement with the downstream mould part 1 and before opening the mould cavity, the gripping tool 8 penetrates the mould material and grips a part of the casting 5 to be extracted in a fixed position and orientation secured by the closed mould cavity and the gripping tool 8 provides a positive, fixed engagement to the casting 5. Thereafter, as shown in FIG. 4, the mould cavity is opened by removing the downstream mould part 1 by means of the removing means 9.

In the embodiment shown in FIG. 4, the gripped casting 5 and the upstream mould part 2 are kept stationary by keeping the gripping tool stationary during the opening. Another possibility would be to move the gripping tool 8 synchronously with the removing means 9, whereby the casting 5 would follow the downstream mould part 1 during the opening. After opening the mould cavity by removing the downstream mould part 1, the casting 5 is extracted from the mould cavity by moving the gripping tool 8, firmly gripping the casting 5.

As shown in FIG. 5, a supporting structure 15 is moved in to support the casting 5 before extracting the casting from the mould part 2, said supporting structure 15 being swingably connected to the robot for the gripping tool 8 in order to move the two elements, gripping tool 8 and supporting structure 15, synchronously during extraction and movement to the delivery position for further processing of the casting 5.

It is preferred that the downstream mould part 1 is delivered to a mould-sand-regeneration system (not shown) substantially in one piece, in order to reduce the amount of dust in the extraction station. Preferably, the apparatus comprises detection means (not shown) for detecting e.g. the dividing line between the two downstream mould parts 1, 2, in order to position the gripping tool 8 to precisely grip the casting 5 inside the closed mould.

Although the invention has been described above with reference to a mould-string foundry plant with vertical parting surfaces between mould parts, it is obvious that it could also be used in foundry plants using moulds with horizontal parting surfaces between mould parts.

Furthermore, the gripping of the casting from one side of the mould is only one possibility, and gripping from the top or at any angle relative to the mould could also be envisaged, all such modifications being within the scope of the following claims.

What is claimed is:

1. Method for extracting the castings produced in a mould foundry plant, comprising an extraction station receiving the mould parts with solidified castings positioned in the mould cavities at the mould-parting surface between mould parts, characterized by comprising the steps of:

a) gripping a part of the casting to be extracted in a fixed position and orientation before opening the mould cavity containing said casting, said gripping providing a positive, fixed, direct engagement between a gripping tool and the casting, b) opening the mould cavity containing the gripped casting by removing a first mould part from the casting, c) after opening the mould cavity, extracting the gripped casting from the mould cavity, and d) moving the casting to a delivery position for further processing thereof.

2. Method in accordance with claim 1, characterized by comprising removing selected parts of the mould parts before step a) in order to provide a certain clearance for bringing the gripping tool into engagement with the part of the casting to be gripped in step a).

3. Method in accordance with claim 1, characterized by comprising insertion of a supporting structure under the casting before step c), said supporting structure following the subsequent movements of the gripping tool and the casting.

4. Method in accordance with claim 1, characterized by step b) comprising gripping the first mould part and removal thereof substantially in one piece and delivery of the removed mould part to a mould sand regeneration system.

5. Method in accordance with claim 1, characterized by comprising detecting the position of the moulds before step a) in order to correctly position the gripping toot relative to the part of the casting to be gripped.

6. Apparatus for extracting the castings produced in a mould foundry plant at an extraction station, said apparatus comprising:

a conveying means for advancing the mould parts containing castings in a solid state in the casting cavities formed at the parting surfaces between mould parts, a gripping tool adapted to grip the casting to be extracted in a fixed position and orientation between the mould parts without opening the mould cavity containing said casting and to provide a positive, fixed, direct engagement with the casting, and means for removing a first mould part to open the mould cavity, said gripping tool being adapted to extract the gripped casting from the opened mould cavity and to move the gripped casting to a position in which the casting is delivered in a well-defined position and orientation for further processing.

7. Apparatus in accordance with claim 6, characterized by further comprising means for removing parts of the mould adjacent the part of the casting to be gripped by the gripping tool.

8. Apparatus in accordance with claim 6, characterized, by further comprising a supporting structure adapted to be inserted underneath the casting after removal of the first mould part, for supporting the casting during extraction and movement to the delivery position, said supporting structure being associated with the gripping tool.

9. Apparatus in accordance with claim 6, characterized, by the means for removing the first mould part comprising a robot gripper adapted to grip and carry the first mould part and deliver the gripped mould part ainly in one piece to a mould-sand-regeneration system.

10. Apparatus in accordance with claim 6, characterized, by comprising means for detecting the position of the mould parts, said detecting being used to correctly position the gripping tool relative to the part of the casting to be gripped.

* * * * *